US008294664B2

(12) United States Patent
Lu et al.

(10) Patent No.: US 8,294,664 B2
(45) Date of Patent: Oct. 23, 2012

(54) ELECTROPHORETIC DISPLAY FOR REDUCING DAMAGE PROPERTY OF ELEMENTS

(75) Inventors: Chi-Ming Lu, Changhua County (TW); Hung-Hsiang Chen, Taoyuan County (TW); Jhen-Shen Liao, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 443 days.

(21) Appl. No.: 12/607,066

(22) Filed: Oct. 28, 2009

(65) Prior Publication Data

US 2011/0057912 A1 Mar. 10, 2011

(30) Foreign Application Priority Data

Sep. 4, 2009 (TW) ..... 98129878 A

(51) Int. Cl.
*G09G 3/34* (2006.01)

(52) U.S. Cl. ..... 345/107

(58) Field of Classification Search ..... 345/107
See application file for complete search history.

(56) References Cited

U.S. PATENT DOCUMENTS

| | | | | |
|---|---|---|---|---|
| 2006/0209011 | A1* | 9/2006 | Miyasaka | 345/107 |
| 2006/0232547 | A1* | 10/2006 | Johnson et al. | 345/107 |
| 2007/0164982 | A1* | 7/2007 | Zhou | 345/107 |
| 2008/0018589 | A1* | 1/2008 | Shih | 345/107 |
| 2008/0024431 | A1* | 1/2008 | Ishii | 345/107 |

* cited by examiner

*Primary Examiner* — Adam J Snyder
(74) *Attorney, Agent, or Firm* — Jianq Chyun IP Office

(57) ABSTRACT

An electrophoretic display and a driving method thereof are provided. The electrophoretic display includes a display panel and a source driver. The display panel includes at least one pixel unit. The pixel unit is coupled to a pixel electrode and a common electrode. The source driver is coupled to the display panel. When the source driver provides a first driving voltage to the pixel electrode having a second driving voltage, the source driver provides a ground voltage to the pixel electrode, and then the source driver provides first driving voltage to the pixel electrode. The ground voltage is between the first driving voltage and the second driving voltage. Thereby, damage property of elements may be reduced.

6 Claims, 5 Drawing Sheets

ELECTROPHORETIC DISPLAY FOR REDUCING DAMAGE PROPERTY OF ELEMENTS

CROSS-REFERENCE TO RELATED APPLICATION

This application claims the priority benefit of Taiwan application serial no. 98129878, filed on Sep. 4, 2009. The entirety of the above-mentioned patent application is hereby incorporated by reference herein and made a part of specification.

BACKGROUND OF THE INVENTION

1. Field of Invention

The present invention relates to an electrophoretic display, and more particular, to a driving technology of the electrophoretic display.

2. Description of Related Art

In an electrophoretic display, charged particles are used to reflect an external light source to display a frame. The electrophoretic display has characteristics of being light, thin, flexible, so that the electrophoretic display is popular with people.

A source driver and a gate driver of the electrophoretic display are coupled to a plurality of pixel units. The pixel units are coupled to a pixel electrode and a common electrode. Generally specking, driving methods of the electrophoretic display include an alternating current (AC) driving method and a direct current driving method. First, the alternating current (AC) driving method of the electrophoretic display is described below.

FIG. 1 is a conventional waveform diagram showed voltages at a common electrode and a pixel electrode under an AC driving method. Referring to the FIG. 1, when a period is changed from a frame period F1 (for example writing a white frame) to a frame period F2 (for example writing a black frame), a voltage of a pixel electrode is changed from a positive voltage Vpos (for example, the positive voltage Vpos is 15V) to a negative voltage Vneg (for example, the negative voltage Vneg is −15V).

It should be noted, in the frame period F1, a capacitor having a voltage difference Vneg−Vpos (for example, the voltage difference is 15V) is existed between the common electrode and the pixel electrode. When period is change from the frame period F1 to the frame period F2, the voltage of the common electrode may be influenced by the voltage variation of the pixel electrode and the capacitor and then changed from the voltage Vneg (−15V) to the voltage Vneg+(Vneg−Vpos) (−15V−30V=−45V) in a moment. The event that the voltage of the common electrode is changed to −45V may easily damage a pixel transistor, the source driver and the gate driver.

FIG. 2 is a conventional waveform diagram showed a voltage outputted by a gate driver under an AC driving method. FIG. 3 is a conventional waveform diagram showed a voltage outputted by a source driver under an AC driving method. The FIG. 2 and the FIG. 3 show that when the voltage of the common electrode is changed to −45V in a moment, an output voltage of the gate driver and the source driver are influenced (show as dotted circles I1 and I2)

FIG. 4 is a conventional waveform diagram showed voltages at a common electrode and a pixel electrode under a DC driving method. The DC driving method is similar to the AC driving method, the voltage vibration of the pixel electrode and the common electrode also may easily damage elements, and the repeated descriptions are omitted herein.

SUMMARY OF THE INVENTION

The present invention provides an electrophoretic display that may decrease damage property of elements.

The present invention provides a driving method of an electrophoretic display, and the driving method may decrease the voltage vibration of the pixel electrode.

An electrophoretic display is provided in the present invention. The electrophoretic display includes a display panel and a source driver. The display panel includes at least one pixel unit, wherein the pixel unit is coupled to a pixel electrode and a common electrode. The source driver is coupled to the display panel. When the source driver provides a first driving voltage to the pixel electrode having a second driving voltage, the source driver provides a first ground voltage to the pixel electrode and then provides the first driving voltage to the pixel electrode. The first ground voltage is between the first driving voltage and the second driving voltage.

In an embodiment of in the present invention, when the source driver provides the second driving voltage to the pixel electrode having the first driving voltage, the source driver provides the first ground voltage to the pixel electrode and then provides the second driving voltage to the pixel electrode.

In an embodiment of in the present invention, the electrophoretic display further includes a power supply. The power supply is coupled to the common electrode. When the power supply provides a first common electrode voltage to the common electrode having a second common electrode voltage, the power supply provides a second ground voltage to the common electrode and then provides the first common electrode voltage to the common electrode. The second ground voltage is between the first common electrode voltage and the second common electrode voltage. In another embodiment, when the power supply provides the second common electrode voltage to the common electrode having the first common electrode voltage, the power supply provides the second ground voltage to the common electrode and then provides the second common electrode voltage to the common electrode.

In an embodiment of in the present invention, the power supply includes a first transistor, a second transistor, a first resistor, a second resistor, and a third resistor. A base terminal of the first transistor receives a first control signal. A first terminal of the first transistor is coupled to a first voltage. The first resistor is coupled between the base terminal of the first transistor and a second voltage. A first terminal of the second resistor is coupled to a second terminal of the first transistor. A first terminal and a second terminal of the third resistor are respectively coupled to a second terminal of the second resistor and the first common electrode voltage. A base terminal and a first terminal of the second transistor are respectively coupled to the first terminal and the second terminal of the third resistor. A second terminal of the second transistor is coupled to an output terminal of the power supply. In another embodiment, the power supply further includes a fourth resistor. The fourth resistor is coupled between the second ground voltage and the output terminal of the power supply.

In an embodiment of in the present invention, power supply further includes a third transistor, a fourth transistor, a fifth resistor, a sixth resistor, and a seventh resistor. A base terminal of the third transistor receives a second control signal. A first terminal of the third transistor is coupled to a third voltage. The fifth resistor is coupled to the base terminal of the third transistor and a fourth voltage. A first terminal of the sixth resistor is coupled to a second terminal of the third transistor. A first terminal and a second terminal of the seventh resistor are respectively coupled to a second terminal of the sixth resistor and the second common electrode voltage. A base terminal and a first terminal of the fourth transistor are respectively coupled to the first terminal and the second terminal of the seventh resistor. A second terminal of the fourth transistor is coupled to the output terminal of the power supply. In another embodiment, the first transistor and the fourth transistor are N-channel bipolar transistors. The second transistor and the third transistor are P-channel bipolar transistors.

According to another aspect of the present invention, a driving method of an electrophoretic display is provided. In the driving method, when providing a first driving voltage to a pixel electrode having a second driving voltage, providing a ground voltage to the pixel electrode and then providing the first driving voltage to the pixel electrode, wherein the ground voltage is between the first driving voltage and the second driving voltage.

In the present invention, when providing a first driving voltage to a pixel electrode having a second driving voltage, providing a ground voltage to the pixel electrode and then providing the first driving voltage to the pixel electrode, wherein the ground voltage is between the first driving voltage and the second driving voltage. Thereby, damage property of elements may be decreased.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
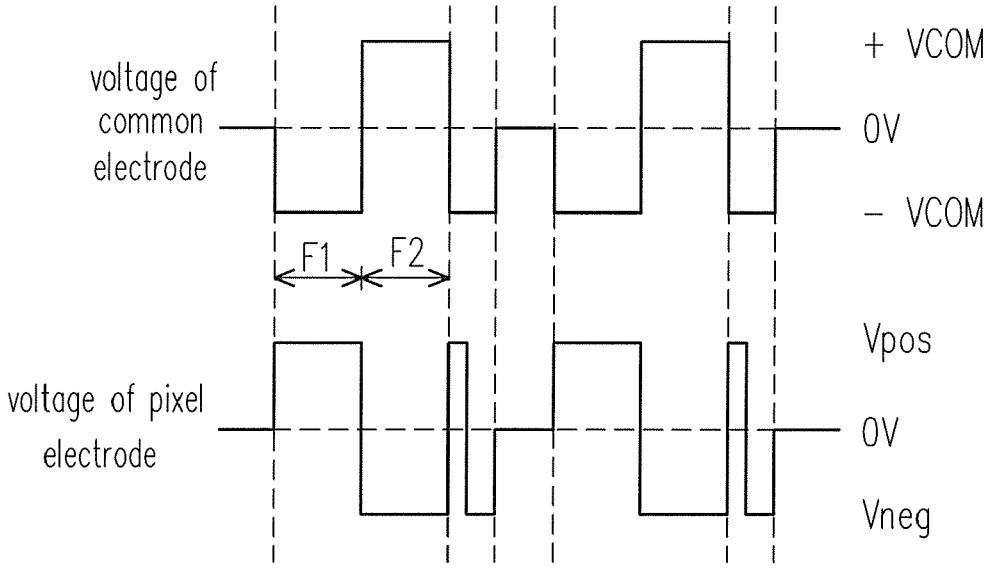
FIG. 1 is a conventional waveform diagram showed voltages at a common electrode and a pixel electrode under an AC driving method.
Figure 2:
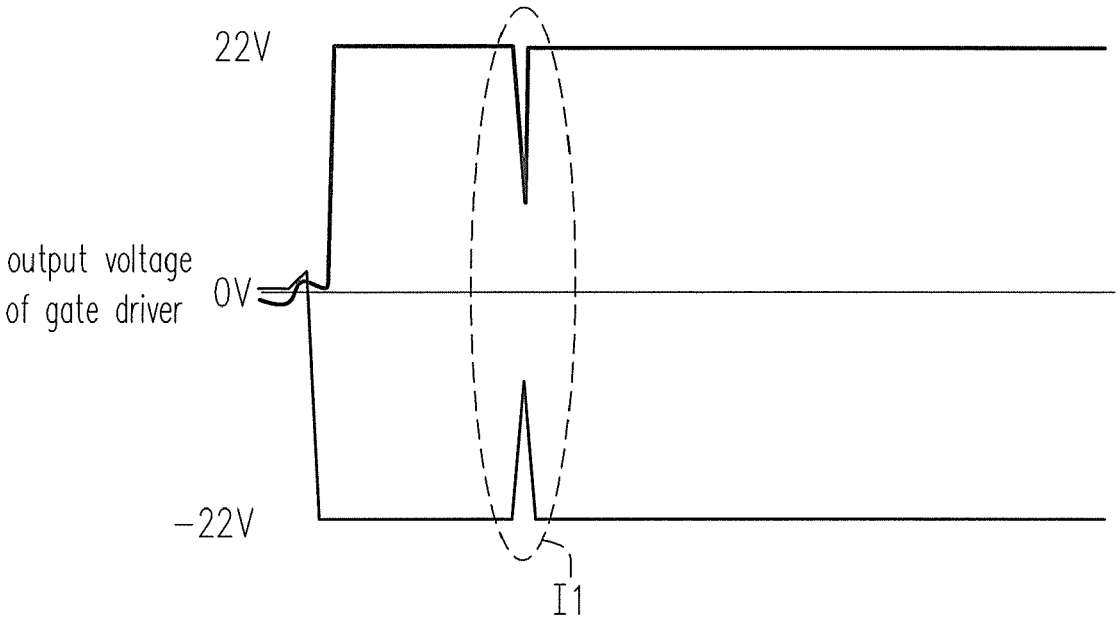
FIG. 2 is a conventional waveform diagram showed a voltage outputted by a gate driver under an AC driving method.
Figure 3:
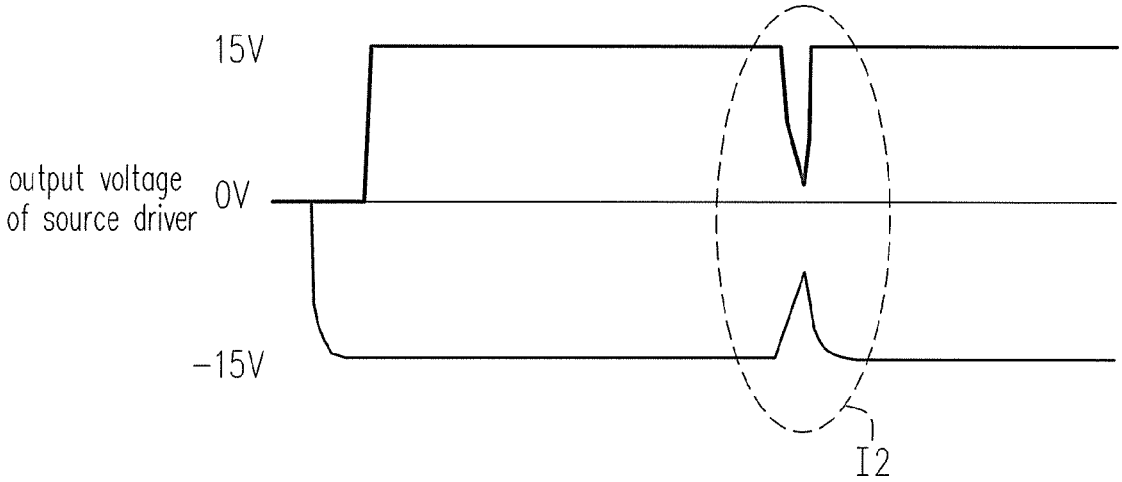
FIG. 3 is a conventional waveform diagram showed a voltage outputted by a source driver under an AC driving method.
Figure 4:
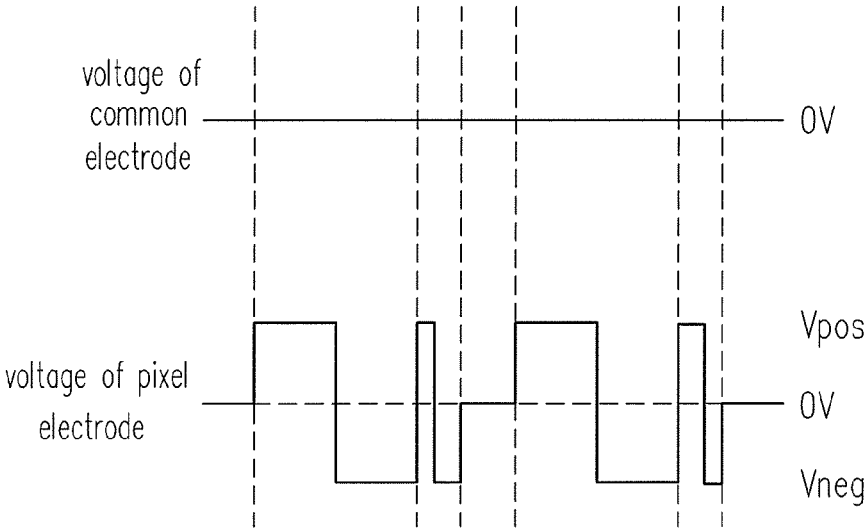
FIG. 4 is a conventional waveform diagram showed voltages at a common electrode and a pixel electrode under a DC driving method.

Reference will now be made in detail to the present embodiments of the invention, examples of which are illustrated in the accompanying drawings. Wherever possible, the same reference numbers are used in the drawings and the description to refer to the same or like parts.

In the convention, the voltage vibration of the pixel electrode and the common electrode are violent in a moment, thereby elements may be damaged. Accordingly, in the embodiments of the present invention, when providing a first driving voltage to a pixel electrode having a second driving voltage, providing a ground voltage to the pixel electrode and then providing the first driving voltage to the pixel electrode, wherein the ground voltage is between the first driving voltage and the second driving voltage. Thereby, the ground voltage can be served as a buffer voltage to decrease the damage property of the elements.

Further, when providing a first common electrode voltage to a common electrode having a second common electrode voltage, providing the ground voltage to the common electrode and then providing the first common electrode voltage to the common electrode, wherein the ground voltage is between the first common electrode voltage and the second common electrode voltage. Thereby, the damage property of the elements can be decreased.

Figure 5:
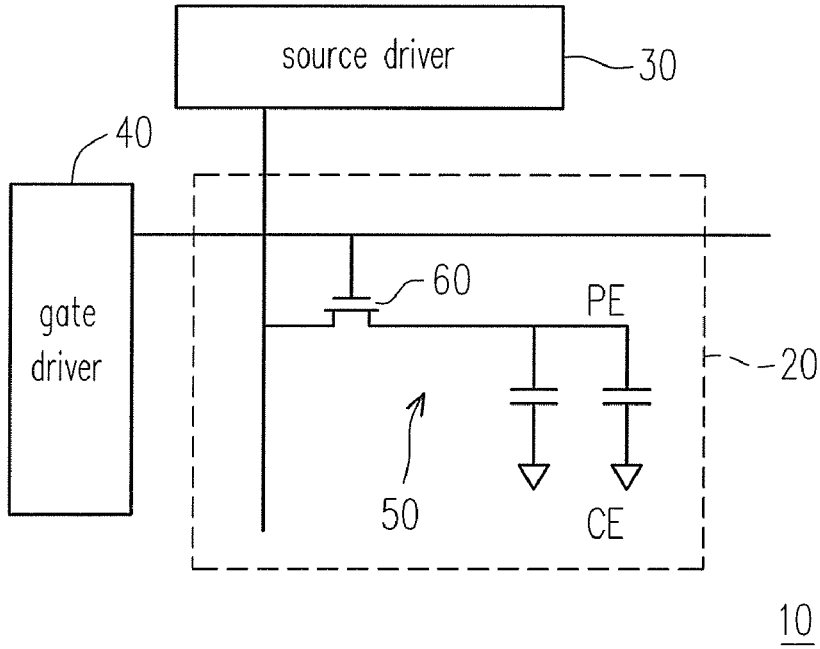
FIG. 5 is a diagram of an electrophoretic display according to an embodiment of the present invention.

FIG. 5 is a diagram of an electrophoretic display according to an embodiment of the present invention. Referring to the FIG. 5, the electrophoretic display 10 includes a display panel 20, a source driver 30 and a gate driver 40. The display panel 20 includes at least one pixel unit 50. The pixel unit 50 is coupled to a pixel electrode PE and a common electrode CE. The source driver 30 is coupled to a source terminal of a pixel transistor 60 in the pixel unit 50. The gate driver 40 is coupled to a gate terminal of the pixel transistor 60.

Figure 6:
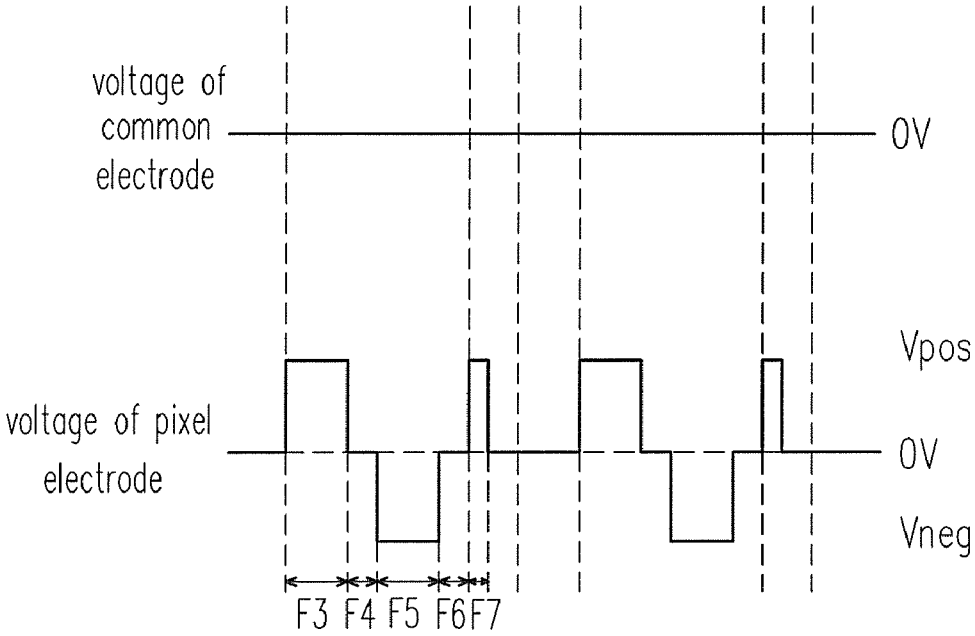
FIG. 6 is a waveform diagram showed voltages at a common electrode and a pixel electrode under a DC driving method according to an embodiment of the present invention.

In the present embodiment, the electrophoretic display 10 operates in a DA driving method. FIG. 6 is a waveform diagram showed voltages at a common electrode and a pixel electrode under a DC driving method according to an embodiment of the present invention. In the present embodiment, when the source driver 30 provides a driving voltage Vneg (for example, the driving voltage Vneg is −15V) to the pixel electrode PE having a driving voltage Vpos (for example, the driving voltage Vpos is +15V) (a period is changed from the frame period F3 to the frame period F5), the source driver 30 provides a ground voltage to the pixel electrode PE (the frame period F4) and then provides the driving voltage Vneg to the pixel electrode PE (the frame period F5). The frame period F4 is, for example but not limited to, a frame period. In another embodiment, the frame period F4 may be include a plurality of frame period. Since the ground voltage is between the driving voltage Vpos and the driving voltage Vneg, the ground voltage has a buffer effect to decrease damage property of elements.

When the source driver 30 provides the driving voltage Vpos to the pixel electrode PE having the driving voltage Vneg (for example, a period is changed from the frame period F5 to the frame period F7), the source driver 30 provides the ground voltage to the pixel electrode PE (frame period F6) and then provides the driving voltage Vpos to the pixel electrode PE (frame period F7). The frame period F6 is, for example but not limited to, a frame period. In another embodiment, the frame period F6 may be include a plurality of frame period. Thereby, the same effect can be achieved. The repeated descriptions about a follow-up driving method are omitted herein.

It should be mentioned that even though a possible pattern of the electrophoretic display and the driving method thereof has been described in foregoing embodiment, those having ordinary knowledge in the art should understand that different manufacturers have different designs in the electrophoretic display and the driving method thereof, and accordingly the application of the present invention should not be limited to this possible pattern. In other words, it is within the spirit of the present invention as long as when providing a first driving voltage to a pixel electrode having a second driving voltage, providing a ground voltage which is between the first driving voltage and the second driving voltage to the pixel electrode and then providing the first driving voltage to the pixel electrode. Some other embodiments of the present invention will be described below so that those having ordinary knowledge in the art can further understand the spirit of the present invention and implement the present invention according to the present disclosure.

Figure 7:
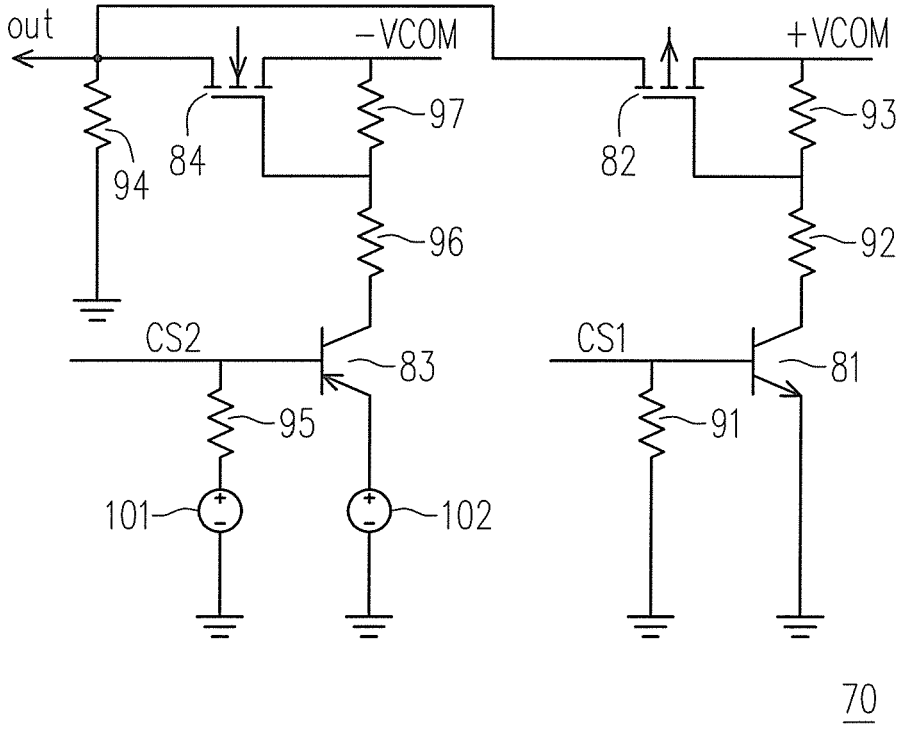
FIG. 7 is a diagram of a power supply according to another embodiment of the present invention.

In the foregoing embodiment, the electrophoretic display 10 operates in the DC driving method, but not limited to. For example, the electrophoretic display 10 may operates in an AC driving method. FIG. 7 is a diagram of a power supply according to another embodiment of the present invention. In the present embodiment, the electrophoretic display 10 further includes a power supply 70. The power supply 70 includes, for example, transistors 81~84, resistors 91~97 and DC power sources 101, 102. The transistor 81 and 84 are, for example, N-channel bipolar transistors. The transistor 82 and 83 are, for example, P-channel bipolar transistors. The DC power source 101 and 102 are, for example, 3V DC power sources.

An output terminal out of the power supply 70 is coupled to the common electrode CE. The power supply 70 may provide a common electrode voltage +VCOM, −VCOM or a ground voltage to the common electrode CE. Control signals CS1 and CS2 are used to control the transistor 81 and 83 respectively. When the transistor 81 is conducted, the transistor 82 is conducted. On the contrast, when the transistor 81 is cut off, transistor 82 is cut off. When the transistor 83 is conducted, the transistor 84 is conducted. On the contrast, when the transistor 83 is cut off, transistor 84 is cut off.

When the transistors 81 and 82 are conducted and the transistors 83 and 84 are cut off, the power supply 70 provides the common electrode voltage +VCOM to the common electrode CE. When the transistors 83 and 84 are conducted and the transistors 81 and 82 are cut off, the power supply 70 provides the common electrode voltage −VCOM to the common electrode CE. When the transistors 81, 82, 83, and 84 are cut off, the power supply 70 provides the ground voltage to the common electrode CE.

Figure 8:
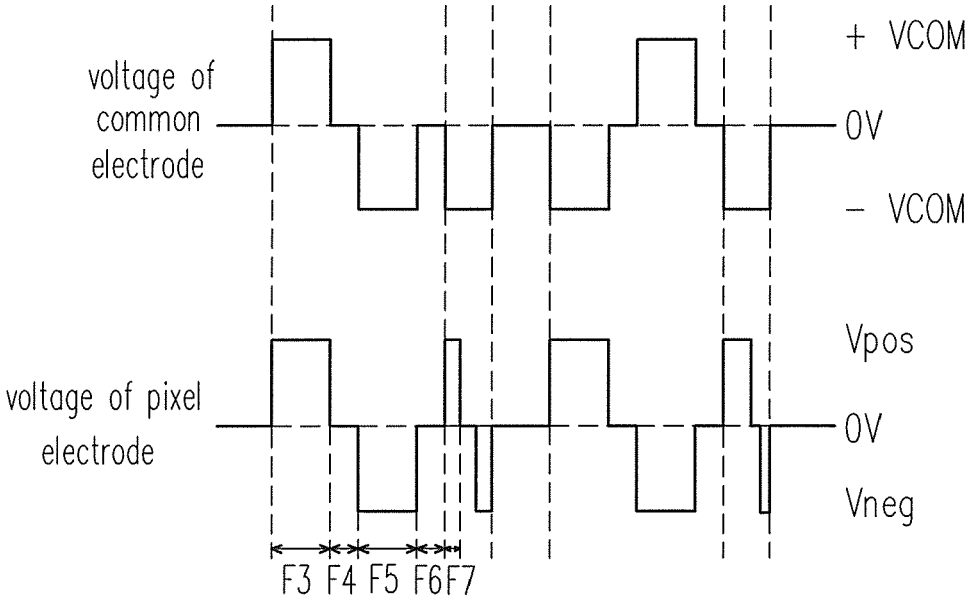
FIG. 8 is a waveform diagram showed voltages at a common electrode and a pixel electrode under an AC driving method according to another embodiment of the present invention.

FIG. 8 is a waveform diagram showed voltages at a common electrode and a pixel electrode under an AC driving method according to another embodiment of the present invention. In the present embodiment, a method that the source driver 30 provides the driving voltage to the pixel electrode PE is similar to the method of the foregoing embodiment, and the repeated descriptions are omitted herein. It should be noted, when the power supply 70 provides the common electrode voltage +VCOM (for example, the common electrode voltage +VCOM is +15V) to the common electrode CE having the driving voltage −VCOM (for example, the driving voltage −VCOM is −15V) (a period is changed from the frame period F3 to the frame period F5), the power supply 70 provides the ground voltage to the common electrode CE (frame period F4) and then provides the common electrode voltage +VCOM to the common electrode CE (frame period F5). Since the ground voltage is between the common electrode voltage +VCOM and −VCOM, the ground voltage has a buffer effect to decrease damage property of elements.

When the power supply 70 provides the common electrode voltage −VCOM to the common electrode CE having the driving voltage +VCOM (for example, a period is changed from the frame period F5 to the frame period F7), the power supply 70 provides the ground voltage to common electrode CE (frame period F6) and then provides the common electrode voltage −VCOM to the common electrode CE (frame period F7). Thereby, achieving the same effect as in the foregoing embodiment. The repeated descriptions about a follow-up driving method are omitted herein.

Figure 9:
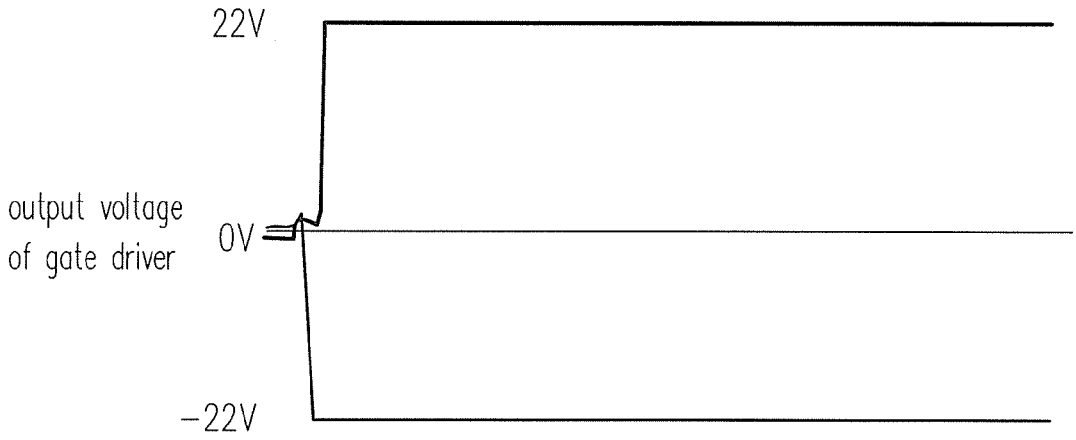
FIG. 9 is a waveform diagram showed a voltage outputted by a gate driver under an AC driving method according to another embodiment of the present invention.
Figure 10:
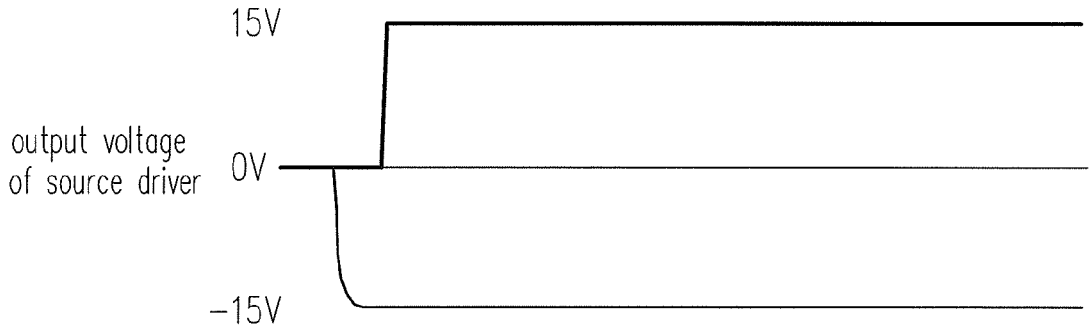
FIG. 10 is a waveform diagram showed a voltage outputted by a source driver under an AC driving method according to another embodiment of the present invention.

FIG. 9 is a waveform diagram showed a voltage outputted by a gate driver under an AC driving method according to another embodiment of the present invention. FIG. 10 is a waveform diagram showed a voltage outputted by a source driver under an AC driving method according to another embodiment of the present invention. The FIG. 9 and the FIG. 10 show that when voltage vibrations of the common electrode CE and the pixel electrode PE is violent, the ground voltage can be used to serve as a buffer, so that the output of the gate driver 40 and the source driver 30 may not be influenced.

As described above, in the present invention, when providing a first driving voltage to a pixel electrode having a second driving voltage, providing a ground voltage which is between the first driving voltage and the second driving voltage to the pixel electrode and then providing the first driving voltage to the pixel electrode. Thereby, the damage property of elements can be decreased. Further, in the embodiments of the present invention, when providing a first common electrode voltage to a common electrode having a second common electrode voltage, providing the ground voltage which is between the first common electrode voltage and the second common electrode voltage to the common electrode and then providing the first common electrode voltage to the common electrode.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An electrophoretic display, comprising:

a display panel, comprising at least one pixel unit, wherein the pixel unit is coupled to a pixel electrode and a common electrode;

a source driver, coupled to the display panel, wherein when the source driver provides a first driving voltage to the pixel electrode having a second driving voltage, the source driver provides a first ground voltage to the pixel electrode and then provides the first driving voltage to the pixel electrode, and the first ground voltage is between the first driving voltage and the second driving voltage; and a power supply, coupled to the common electrode, wherein when the power supply provides a first common electrode voltage to the common electrode having a second common electrode voltage, the power supply provides a second ground voltage to the common electrode and then provides the first common electrode voltage to the common electrode, and the second ground voltage is between the first common electrode voltage and the second common electrode voltage, wherein the power supply comprises:

a first transistor, wherein a base terminal of the first transistor receives a first control signal, and a first terminal of the first transistor is coupled to a first voltage;

a first resistor, coupled between the base terminal of the first transistor and a second voltage;

a second resistor, wherein a first terminal of the second resistor is coupled to a second terminal of the first transistor;

a third resistor, wherein a first terminal and a second terminal of the third resistor are respectively coupled to a second terminal of the second resistor and the first common electrode voltage; and a second transistor, wherein a base terminal and a first terminal of the second transistor are respectively coupled to the first terminal and the second terminal of the third resistor, and a second terminal of the second transistor is coupled to an output terminal of the power supply.

2. The electrophoretic display as claimed in claim 1, wherein when the source driver provides the second driving voltage to the pixel electrode having the first driving voltage, the source driver provides the first ground voltage to the pixel electrode and then provides the second driving voltage to the pixel electrode.

3. The electrophoretic display as claimed in claim 1, wherein when the power supply provides the second common electrode voltage to the common electrode having the first common electrode voltage, the power supply provides the second ground voltage to the common electrode and then provides the second common electrode voltage to the common electrode.

4. The electrophoretic display as claimed in claim 1, wherein the power supply further comprises:

a fourth resistor, coupled between the second ground voltage and the output terminal of the power supply.

5. The electrophoretic display as claimed in claim 4, wherein the power supply further comprises:

a third transistor, wherein a base terminal of the third transistor receives a second control signal, and a first terminal of the third transistor is coupled to a third voltage;

a fifth resistor, coupled to the base terminal of the third transistor and a fourth voltage;

a sixth resistor, wherein a first terminal of the sixth resistor is coupled to a second terminal of the third transistor;

a seventh resistor, wherein a first terminal and a second terminal of the seventh resistor are respectively coupled to a second terminal of the sixth resistor and the second common electrode voltage; and a fourth transistor, wherein a base terminal and a first terminal of the fourth transistor are respectively coupled to the first terminal and the second terminal of the seventh resistor, and a second terminal of the fourth transistor is coupled to the output terminal of the power supply.

6. The electrophoretic display as claimed in claim 5, wherein the first transistor and the fourth transistor are N-channel bipolar transistors, the second transistor and the third transistor are P-channel bipolar transistors.

* * * * *